US008760066B2

(12) United States Patent
Lenk

(10) Patent No.: US 8,760,066 B2
(45) Date of Patent: Jun. 24, 2014

(54) CONSTANT POWER LED CIRCUIT

(75) Inventor: Ronald J. Lenk, Woodstock, GA (US)

(73) Assignee: Switch Bulb Company, Inc., San Jose, CA (US)

( * ) Notice: Subject to any disclaimer, the term of this patent is extended or adjusted under 35 U.S.C. 154(b) by 640 days.

(21) Appl. No.: 13/059,392

(22) PCT Filed: Aug. 14, 2009

(86) PCT No.: PCT/US2009/004663

§ 371 (c)(1),
(2), (4) Date: May 23, 2011

(87) PCT Pub. No.: WO2010/021677

PCT Pub. Date: Feb. 25, 2010

(65) Prior Publication Data

US 2011/0215728 A1 Sep. 8, 2011

Related U.S. Application Data

(60) Provisional application No. 61/089,618, filed on Aug. 18, 2008.

(51) Int. Cl.
*H05B 37/02* (2006.01)

(52) U.S. Cl.
USPC ..... 315/209 R; 315/224; 315/307

(58) Field of Classification Search
USPC ..... 315/209 R, 224, 225, 276, 291, 307
See application file for complete search history.

(56) References Cited

U.S. PATENT DOCUMENTS

| | | | | |
|---|---|---|---|---|
| 5,126,634 | A | 6/1992 | Johnson | |
| 5,274,611 | A | 12/1993 | Donohoe | |
| 5,296,783 | A | 3/1994 | Fischer | |
| 5,835,361 | A | 11/1998 | Fitzgerald | |
| 6,094,362 | A | 7/2000 | Domingo | |
| 6,362,573 | B1 | 3/2002 | Helbing et al. | |
| 6,456,015 | B1 | 9/2002 | Lovell et al. | |
| 6,717,374 | B2 | 4/2004 | Krummel | |
| 7,276,861 | B1 | 10/2007 | Shteynberg et al. | |
| 7,358,679 | B2 | 4/2008 | Lys et al. | |
| 7,863,831 | B2 | 1/2011 | Vos | |
| 7,872,430 | B2 * | 1/2011 | Roberts et al. | 315/307 |
| 7,944,153 | B2 * | 5/2011 | Greenfeld | 315/291 |
| 7,986,107 | B2 | 7/2011 | Weaver et al. | |
| 7,999,484 | B2 * | 8/2011 | Jurngwirth et al. | 315/247 |
| 8,264,165 | B2 | 9/2012 | Gu et al. | |
| 2006/0244396 | A1 | 11/2006 | Bucur | |
| 2007/0040696 | A1 | 2/2007 | Mubaslat et al. | |
| 2007/0120507 | A1 | 5/2007 | Uchida et al. | |
| 2007/0228999 | A1 | 10/2007 | Kit | |
| 2008/0013324 | A1 | 1/2008 | Yu | |
| 2008/0024070 | A1 | 1/2008 | Catalano et al. | |

(Continued)

OTHER PUBLICATIONS

Non Final Office Action received for U.S. Appl. No. 12/625,486, mailed on Nov. 14, 2011, 16 pages.

(Continued)

*Primary Examiner* — Jimmy Vu
(74) *Attorney, Agent, or Firm* — Morrison & Foertster LLP

(57) ABSTRACT

A constant power drive for light emitting diodes, such that there is automatic compensation for variation in forward voltage of the LED, both in a single unit with temperature, and also due to unit-to-unit variations.

17 Claims, 1 Drawing Sheet

(56) References Cited

U.S. PATENT DOCUMENTS

| | | | |
|---|---|---|---|
| 2008/0198615 | A1 | 8/2008 | Klipstein |
| 2009/0195186 | A1 | 8/2009 | Guest et al. |
| 2010/0109557 | A1 | 5/2010 | Bouchard |
| 2010/0308739 | A1 | 12/2010 | Shteynberg et al. |
| 2011/0084615 | A1 | 4/2011 | Welten |
| 2011/0163680 | A1 | 7/2011 | Welten |
| 2011/0248644 | A1 | 10/2011 | Welten et al. |
| 2011/0298374 | A1 | 12/2011 | Lenk et al. |
| 2011/0298375 | A1 | 12/2011 | Canter et al. |
| 2012/0075854 | A1 | 3/2012 | Maxik et al. |
| 2013/0181624 | A1 | 7/2013 | Kang |

OTHER PUBLICATIONS

Non Final Office Action received for U.S. Appl. No. 12/561,514, mailed on Jan. 27, 2012, 11 pages.
International Search Report received for PCT Patent Application No. PCT/US2009/004661, mailed on Oct. 2, 2009, 2 pages.
International Search Report received for PCT Patent Application No. PCT/US2009/004663, mailed on Sep. 22, 2009, 2 pages.
International Search Report received for PCT Patent Application No. PCT/US2009/005021, mailed on Oct. 16, 2009, 2 pages.
International Search Report received for PCT Patent Application No. PCT/US2009/005022, mailed on Nov. 2, 2009, 2 pages.
International Preliminary Report on Patentability received for PCT Patent Application No. PCT/US2009/004661, mailed on Mar. 3, 2011, 6 pages.
International Preliminary Report on Patentability received for PCT Patent Application No. PCT/US2009/004663, mailed on Mar. 3, 2011, 6 pages.
International Preliminary Report on Patentability received for PCT Patent Application No. PCT/US2009/005021, mailed on Mar. 24, 2011, 5 pages.
International Preliminary Report on Patentability received for PCT Patent Application No. PCT/US2009/005022, mailed on Mar. 24, 2011, 6 pages.
International Search Report and Written Opinion received for PCT Patent Application No. PCT/US2013/034176, mailed on Jul. 2, 2013, 8 pages.
Non Final Office Action received for U.S. Appl. No. 13/433,164, mailed on Jan. 10, 2014, 12 pages.

* cited by examiner

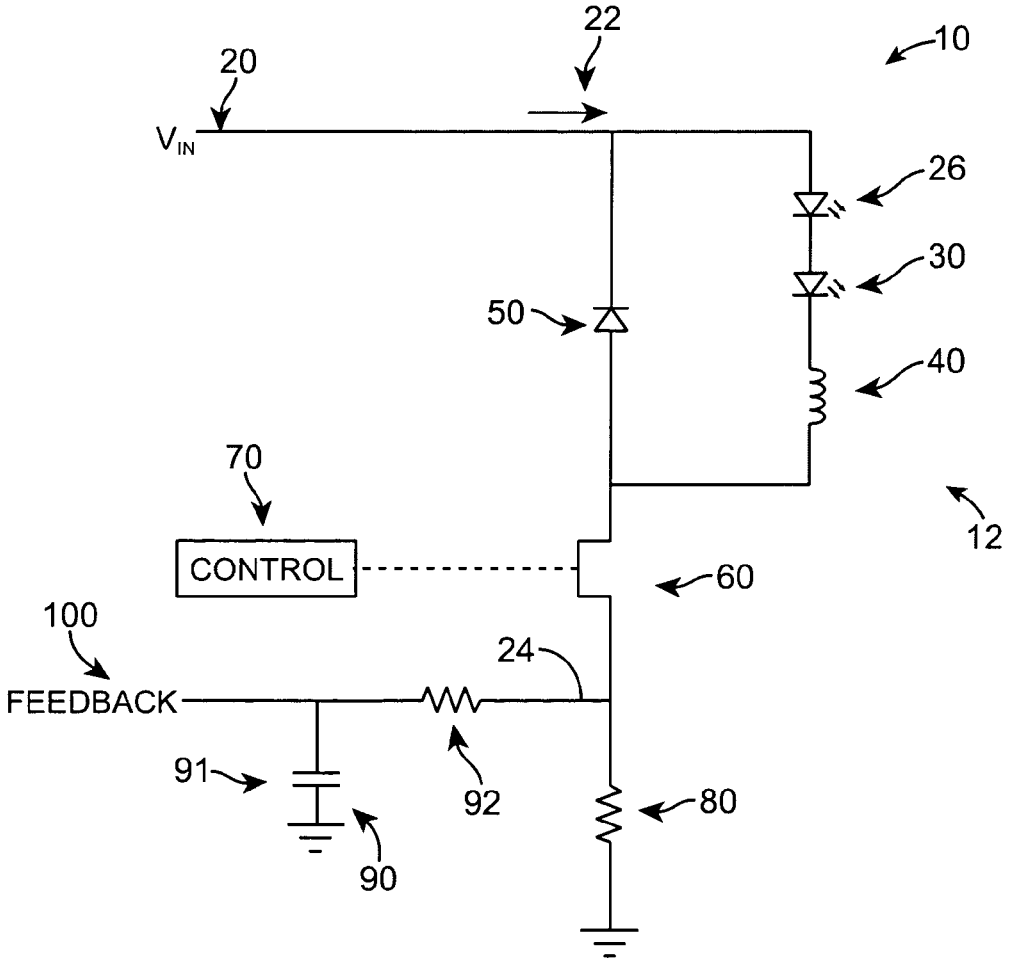
22
10
20
$V_{IN}$
26
30
50
40
70
12
CONTROL
60
100
24
FEEDBACK
91
92
80
90

CONSTANT POWER LED CIRCUIT

FIELD OF THE INVENTION

The present invention relates to providing constant power to light emitting diodes (LEDs), and more particularly, to eliminating temperature and manufacturing variation effects in the light output of LEDs.

BACKGROUND OF THE INVENTION

An LED consists of a semiconductor junction, which emits light due to a current flowing through the junction. Since the purpose of an LED is to emit light, it is often desirable for this light to be as constant as possible, both during operation of a device and also from unit to unit. Many designers of LED circuits use a constant current circuit for this purpose, because this gives a better regulated amount of light output than driving it with a voltage limited by a resistor.

However, the constant current drive still has a number of drawbacks. Among the chief of these is that, although the current through the LED is constant, the forward voltage of the junction is not. The light output of the LED is dependent on its input power, and this power depends on both the junction current and the forward voltage. Any variation of forward voltage thus directly results in variation in output light.

The variation in forward voltage in the LED has two main sources. One is the temperature of the junction. As the LED warms up, its forward voltage decreases, typically 2 to 4 mV/° C., or 0.06 to 0.11%/° C. While this seems small, LED temperatures in normal operation will typically range from 25° C. to at least 85° C., and over this temperature range, the variation in forward voltage can be as much as 6.7%. A variation of this size in light output, when combined with other factors, can be quite undesirable.

The other main source of variation in forward voltage in LEDs is manufacturing tolerance. A typical white LED may have a forward voltage specified to be between 2.8V and 4.0V. This variation translates directly to a variation in light output when using a constant current drive. As a consequence, LED manufacturers typically bin their parts, typically in 100 mV bins. This can reduce the variation to some 2.8%, but taken together, the two effects may still account for almost a 10% variation of light from unit to unit and from cold to hot.

One solution to this problem is to measure the forward voltage of the LED and provide a drive such that the product of this forward voltage and the drive current is constant. In practice, however, because the LEDs may not be ground-referenced, it becomes necessary to use expensive components to level shift the forward voltage signal to where it can be used by the control circuit.

Another partial solution is to measure the temperature of the LED, for example with a thermistor, and use the measurement as a feedback to the control circuit to adjust the drive current. While this concept works in some situations, it can be difficult to implement if the LEDs are not conveniently located. To measure the temperature requires two additional connections from the location of the LEDs for the thermistor, in addition to the two connections required to power the LEDs. Additionally, the control circuit must be configured to accept the input from the thermistor. If the signal is not acceptable, it must be conditioned with additional circuitry, or with a microcontroller. However, this method does not compensate for factory variations in forward voltage.

SUMMARY OF THE INVENTION

This invention has the object of developing a constant power drive for light emitting diodes (LEDs), such that the above-described primary problem is effectively solved. It provides an inexpensive circuit that automatically compensates for variation in forward voltage of the LED, both in a single unit with temperature, and also due to unit-to-unit variations. The invention includes a current sensor, such as a resistor, and an integrator, such as a resistor-capacitor low-pass filter. While the current sensor produces a signal proportional to the LED drive current, the integrator produces a signal proportional to the duty cycle, which in turn is proportional to the forward voltage of the LED. When the current sensor input is fed to the integrator, the output is a signal proportional to the product of the LED drive current and the LED forward voltage, which is the LED power.

The time constant of the integrator must be set appropriately. In particular, it must be substantially longer than the sort of noise filter typically used in such applications, which are typically timed to be roughly the speed of the rising and falling edges of the switching element. In a preferred embodiment, the time constant is 3-10 times as long as the switching period of the switching element.

In a circuit in which the power source to run the LED is the AC line, and the drive circuit is power factor corrected (PFC), an additional constraint is that the time constant of the integrator must be short compared with the AC line frequency. In the preferred embodiment, this condition is naturally fulfilled.

BRIEF DESCRIPTION OF THE DRAWINGS

The accompanying drawing is included to provide a further understanding of the invention, and is incorporated in and constitutes a part of this specification. The drawing illustrates an embodiment of the invention and, together with the description, serves to explain the principles of the invention.

FIG. 1 is a circuit schematic of a constant power circuit for driving a string of LEDs, such that neither variations in temperature of the LEDs, nor lot-to-lot variations of the forward voltage of the LEDs, substantially affects the power with which the LEDs are driven.

DESCRIPTION OF THE PREFERRED EMBODIMENT

Reference will now be made in detail to the present preferred embodiments of the invention, an example of which is illustrated in the accompanying drawing. Wherever possible, the same reference numbers are used in the drawing and the description to refer to the same or like parts.

According to the design characteristics, a detailed description of the preferred embodiment is given below.

FIG. 1 is a schematic of a constant power LED circuit 10. In accordance with a preferred embodiment, at least one LED 30 is powered from an input power source 20. When a transistor switch 60 is turned on by a control circuit 70, current 22 through the at least one LED 30 is ramped up because of inductor 40. When the transistor switch 60 is turned off by the control circuit 70, current 22 through the at least one LED 30 is ramped down because of inductor 40. In the turned-on configuration ("on configuration"), current 22 from the at least one LED 30 and inductor 40 passes through the transistor switch 60. In the turned-off configuration (or "off configuration"), current 22 from the at least one LED 30 and inductor 40 passes through diode 50. The average current 22 through the at least one LED 30 is set by the relative amounts of time the transistor switch 60 spends in the on configuration and the off configuration, the two together being known as a complete switching period. It can be appreciated that in accordance with an exemplary embodiment, the input power source 20, the inductor 40, the diode 50, and the transistor switch 60 combined forms a switch-mode power supply 12.

In accordance with one embodiment, during the period when the transistor switch 60 is in the on configuration, the current 22 passing through the at least one LED 30, the inductor 40, and the transistor switch 60 also passes through a sense resistor (or current sensor) 80 to ground. In accordance with an exemplary embodiment, the sense resistor 80 converts the current 22 from the at least one LED 30 into a voltage signal 24. The voltage signal 24 is then filtered by an integrator 90. In accordance with an exemplary embodiment, the integrator 90 receives (i.e., takes) a signal from the current sensor 80 and combines it with a signal proportional to the duty cycle and forms an output. The output of the integrator 90 is then used as feedback 100, to determine the relative amount of time the transistor switch 60 spends in the on configuration and the off configuration.

In accordance with a preferred embodiment, the integrator 90 consists of a series resistor 92 and a parallel capacitor 91. In accordance with an exemplary embodiment, the time constant of the integrator 90 (or resistor-capacitor circuit) is a multiple of the inverse of the switching frequency of the switch-mode power supply. For example, the time constant of the integrator 90 is preferably set to be approximately 3-10 times longer than the complete switching period of the transistor switch 60.

The current 22 sensed by the current sense resistor 80 is conditioned by the integrator 90. Since the current 22 is present only during the time that the transistor switch 60 is in the on configuration, the integrator 90 produces a voltage 24 that is proportional to the time the transistor switch 60 is in the on configuration. In accordance with an exemplary embodiment, the time the transistor 60 is in the on configuration is dependent on the ratio of the forward voltage 26 of the at least one LED 30 and the voltage of the input power source 20. Thus, the output 100 is proportional to the product of the current through the at least one LED 30 and the forward voltage 26 of the at least one LED 30. Thus, the control circuit 70 regulates the power into the at least one LED 30.

In accordance with an exemplary embodiment, the constant power LED circuit 10 is designed to be a buck converter with a transistor switch (i.e., a buck-derived converter). However, it can be appreciated that any switching circuit providing a signal proportional to the LED current can also be used in a similar circuit. In accordance with another embodiment, the circuit 10 can use LEDs which are ground-referenced, or can use an amplifier or use a current-sense transformer to determine the LED current. The circuit 10 can also use AC-line power, and can be power-factor corrected, so long as the integrator time constant is short compared with the AC-line frequency.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A constant power LED drive circuit comprising:

a switch-mode power supply;

a current sensor providing a signal proportional to an LED current;

an integrator taking the signal from the current sensor and combining the signal from the current sensor with a signal proportional to the duty cycle and forming an output, which determines a relative amount of time for a transistor switch in an on configuration and an off configuration; and wherein the integrator comprises a series resistor and a parallel capacitor, wherein the time constant of the resistor-capacitor circuit is a multiple of the inverse of the switching frequency of the switch-mode power supply, and wherein the multiple of the inverse of the switching frequency of the switch-mode power supply is approximately 3 to 10 times longer than a complete switching period of the transistor switch.

2. A constant power LED drive circuit as set forth in claim 1, wherein the current sensor is a resistor.

3. A constant power LED drive circuit as set forth in claim 1, wherein the current sensor is a transformer.

4. A constant power LED drive circuit as set forth in claim 1, wherein the switch-mode power supply is a buck-derived converter.

5. A constant power LED drive circuit as set forth in claim 1, wherein the switch-mode power supply is power-factor corrected.

6. A constant power LED drive circuit as set forth in claim 1, wherein the switch-mode power supply comprises an input power source, an inductor, a diode, and a transistor switch.

7. A constant power LED drive circuit as set forth in claim 1, further comprising at least one LED.

8. An LED driver circuit, the driver circuit comprising:

a power supply including an inductor and a switching transistor, the power supply configured to supply power with a first duty cycle and a switching frequency;

a current sensor configured to sense an LED current;

an integrator configured to combine a first signal based on the sensed LED current with a second signal based on the first duty cycle to form an output signal;

wherein the integrator comprises a series resistor and a parallel capacitor, a time constant of the resistor-capacitor circuit is a multiple of the inverse of the switching frequency of the power supply, and the multiple of the inverse of the switching frequency of the power supply is 3 to 10 times longer than a complete switching period of the power supply.

9. The LED driver circuit of claim 8, wherein the second signal is proportional to the first duty cycle.

10. The LED driver circuit of claim 8, wherein the current sensor is a resistor configured to convert the LED current into a voltage signal.

11. The LED driver circuit of claim 8, wherein the current sensor is a transformer.

12. The LED driver circuit of claim 8, wherein the power supply is a switch-mode power supply.

13. The LED driver circuit of claim 12, wherein the switch-mode power supply comprises a buck converter.

14. The LED driver circuit of claim 12, wherein the switch-mode power supply is power-factor corrected.

15. The LED driver circuit of claim 8, wherein the power supply comprises an inductor, a diode, and a transistor switch.

16. The LED driver circuit of claim 8, further comprising at least one LED.

17. An LED driver circuit, the driver circuit comprising:

at least one LED;

a power supply electrically connected to the at least one LED, the power supply comprising an indicator and a switching transistor configured to supply power at a duty cycle and a switching frequency;

a current sensor configured to sense a current of the at least one LED;

an integrator configured to combine a first signal based on the sensed current with a second signal based on the duty cycle of the power supply to form an output signal;

wherein the power supply is further configured to change the duty cycle based on the output signal; and wherein the integrator comprises a series resistor and a parallel capacitor, a time constant of the resistor-capacitor circuit is a multiple of the inverse of the switching frequency of the power supply, and the multiple of the inverse of the switching frequency of the power supply is 3 to 10 times longer than a complete switching period of the power supply.

* * * * *

UNITED STATES PATENT AND TRADEMARK OFFICE

CERTIFICATE OF CORRECTION

PATENT NO. : 8,760,066 B2
APPLICATION NO. : 13/059392
DATED : June 24, 2014
INVENTOR(S) : Ronald J. Lenk It is certified that error appears in the above-identified patent and that said Letters Patent is hereby corrected as shown below:

In the Claims

In column 4, claim number 8, line number 35, after "output signal;" insert -- wherein the power supply is further configured to change the first duty cycle to a second duty cycle based on the output signal, wherein the first duty cycle and the second duty cycle are different; and --, therefor.

In column 4, claim number 17, line number 63, delete "indicator" and insert -- inductor --, therefor.

Signed and Sealed this
Fifth Day of July, 2016

Michelle K. Lee

Michelle K. Lee
*Director of the United States Patent and Trademark Office*